US007389553B2

(12) United States Patent
Kotitschke

(10) Patent No.: US 7,389,553 B2
(45) Date of Patent: Jun. 24, 2008

(54) CARRYING APPARATUS FOR RESCUING PERSONS

(75) Inventor: Herbert Kotitschke, Steinheim (DE)

(73) Assignee: Voith Paper Patent GmbH, Heidenheim (DE)

( * ) Notice: Subject to any disclaimer, the term of this patent is extended or adjusted under 35 U.S.C. 154(b) by 171 days.

(21) Appl. No.: 11/228,582

(22) Filed: Sep. 15, 2005

(65) Prior Publication Data

US 2006/0059625 A1 Mar. 23, 2006

(30) Foreign Application Priority Data

Sep. 17, 2004 (DE) ..... 10 2004 045 592
Apr. 26, 2005 (DE) ..... 10 2005 019 283

(51) Int. Cl.
*A61G 1/00* (2006.01)
*A61G 1/04* (2006.01)
*A61G 1/048* (2006.01)

(52) U.S. Cl. ..... 5/626; 5/625; 5/627; 5/629

(58) Field of Classification Search ..... 5/625, 5/626, 627, 628, 629; 128/870; 280/32.6
See application file for complete search history.

(56) References Cited

U.S. PATENT DOCUMENTS 1,431,383 A * 10/1922 Edwards ..... 280/32.6
1,795,435 A * 3/1931 Melzer ..... 5/627
2,394,164 A 2/1946 Robinson
2,400,426 A 5/1946 Liptay et al.
3,135,972 A * 6/1964 Jakes et al. ..... 5/627
3,151,343 A * 10/1964 McCormick ..... 5/627
3,449,776 A * 6/1969 Brock ..... 5/627
4,506,664 A * 3/1985 Brault ..... 5/628
4,895,173 A * 1/1990 Brault et al. ..... 128/870
5,595,191 A * 1/1997 Kirk ..... 128/846
5,623,949 A 4/1997 Kostich et al.
5,771,513 A 6/1998 Kirchgeorg et al.
5,785,058 A * 7/1998 Reynolds ..... 128/869
5,988,173 A * 11/1999 Scruggs ..... 128/870
6,295,672 B1 10/2001 Vassallo, Jr.

FOREIGN PATENT DOCUMENTS

DE 11 48 702 B 5/1963
FR 2 583 977 A 1/1987
GB 2 182 570 A 5/1987

OTHER PUBLICATIONS

European Search Report Dec. 16, 2005.

* cited by examiner

*Primary Examiner*—Alexander Grosz
(74) *Attorney, Agent, or Firm*—Taylor & Aust, P.C.

(57) ABSTRACT

A carrying apparatus for rescuing persons, for example from a space with a small access opening. The carrying apparatus accommodates a person in an elongated transport position, a middle part that is substantially curved in cross section and is open at the top, which accommodates at least the head and the trunk of a person to be transported in a supine position.

14 Claims, 2 Drawing Sheets

A
B
1
2
3
4
5
6
7
8
9
10
11
12
13
14
15
16
17
18
18,19
19
20
20,21
21

CARRYING APPARATUS FOR RESCUING PERSONS

CROSS-REFERENCE TO RELATED APPLICATIONS

The present application claims priority under 35 U.S.C. §119 of German Patent Application No. 10 2004 044 570.2 filed on Sep. 15, 2004, the disclosure of which is expressly incorporated by reference herein in its entirety.

BACKGROUND OF INVENTION

1. Field of the Invention

The invention relates to a carrying apparatus for rescuing persons, in particular from a space with a small access opening, the carrying apparatus accommodating the persons in an elongated transport position.

2. Discussion of Background Information

DE 20 2005 003 316.2 has already disclosed an apparatus for rescuing persons from spaces with small access openings. Use is made of a transport device which accommodates the person to be rescued, which is designed to fix the person accommodated in an elongated transport position and of which the external contour is matched to the access opening.

From time to time it is necessary to enter closed spaces or containers such as drying cylinders or other containers such as boilers in a machine for producing a fibrous web, in particular a paper or board web, for installation, conversion, repair or maintenance purposes, for which purpose one or more persons have to enter the space or the container through a relatively small access opening, for example an oval access opening.

The height and width dimensions of such an elliptical opening are between 280 and 300 mm, on the one hand, and between 380 and 400 mm, on the other hand. For the case in which a person is injured or becomes unconscious during the work, it is necessary to rescue this person from the container, a further difficulty consisting in the fact that there are often restricted space conditions outside the container as well.

The known apparatus is configured as a closed or partly closed tube, which permits a person who, for example, is injured or unconscious to be fixed in an elongated, in particular lying, transport position, with arms either lying at the sides or extended upward and then to push the transport device with the person located in it through the access opening.

SUMMARY OF THE INVENTION

The object of the invention is to provide a more simply constructed apparatus for rescuing persons from a container with a narrow access opening which, in particular, can also be used under restricted space conditions.

According to the invention, in a carrying apparatus of the type named at the beginning, this object is achieved in that it comprises a middle part which is substantially curved in cross section and is open at the top, which accommodates at least the trunk and possibly also the head of a person to be rescued, the person being supported in a supine position.

As a result of the open configuration, the person to be rescued does not become claustrophobic in the carrying apparatus. The carrying apparatus can be used universally. The person to be rescued is preferably placed in the carrying apparatus on the spine, it being possible for hands and arms to be fixed above the head. The person is preferably pushed or pulled out of the container with the head end in front.

The carrying apparatus preferably has a width of 370 to 390 mm and a height of 140 to 150 mm matched to the size of the opening.

Advantageous developments emerge from the subclaims, the description and the drawings.

It is advantageous if the middle part has a contour which corresponds to the contour of the opening, that is to say is curved in cross section and has a greater curvature in the middle than outside. As a result, the carrying apparatus is also given a stable structure.

Advantageously, at least one, preferably two, retaining straps for fastening the trunk of the person to the middle part are provided on the middle part.

In order to be able to transport the person firmly strapped on the carrying apparatus by means of the retaining straps, the carrying apparatus is equipped with carrying handles or holding bars which are fitted or can be fitted in particular at the ends, that is to say as at least one of the two, preferably both, ends, and/or carrying handles or carrying slots present on the long sides.

The carrying handles or holding bars can preferably be pulled out from the middle part or from the head end or from the foot end and picked up, or the holding bars are formed as push-in handles. In addition, the carrying apparatus can be held in slotted, preferably reinforced, openings in the middle part or at the foot end or in the head end.

In order to avoid injury to the face of the person to be rescued, a face guard is provided, which covers the face of a person to be rescued for the purpose of protection against injury during transport.

The face guard is preferably arranged such that it can be adjusted vertically, for example by means of a telescopic device, with respect to the middle part. If the carrying apparatus is not being used, the face guard is, for example, placed on the inner wall of the carrying apparatus. However, it is also advantageous if the face guard can be taken off the middle part.

If the carrying apparatus is not being used, in this case the carrying handles and the face guard can be stowed, for example, in the hollow formed by the inner wall, by means of fastening devices provided for this purpose.

In a further advantageous refinement of the invention, provision is made for the middle part to have a tapered head end and/or a tapered foot end, that is to say a head end and a foot end which each have a circumference and diameter that is reduced with respect to the middle part. By means of this tapered form at the head and foot end, a "streamlined" contour matched to the contour of the body is achieved.

In another development, a hand support is advantageously fitted or can be fitted to the middle part and is used to fix the arms of the person lying on the carrying apparatus in an extended position above the head.

A head part can be associated with the middle part. The hand support is advantageously designed in one piece with the face guard, preferably in the shape of a Z, and can be adjusted vertically and removed jointly. The face guard is nonconfigured as a strap. As a single unit, the face guard and the hand support can include a substantially vertical member therebetween such that the single unit can have the approximate Z-shape, the face guard being positioned above the hand support. The single unit is removably attachable to the middle part and/or the head part.

Of course, however, it is also possible to fix the arms beside the trunk of the person if the space within the middle part permits this.

In a further refinement of the invention, the hand support can advantageously be pulled out of the middle part if, for example, it is arranged at the head end of the middle part. Likewise, the hand support can also be arranged to be removable from the middle part.

It is likewise advantageous if at least one retaining strap is fitted to the hand support, in order to use this to fix the hands of the person to be transported to the hand support.

In a further refinement of the invention, a foot support for supporting the feet and, if appropriate, also the lower legs is fitted to the middle part or can be fitted to the latter if the middle part does not have a sufficient length to accommodate persons with a greater body length as well. However, if a foot support is used, the length of the middle part may be restricted to about 1200 mm to 1500 mm, which means that a minimum longitudinal extent is achieved. Once the hands and arms of the transported person are outside the container, then these can advantageously or else of necessity be pivoted rearward during the further withdrawal of the person and laid on the body.

The foot support can also be pulled out and/or pivoted out of the middle part, in particular in the horizontal and/or vertical direction; likewise, it is possible to provide for the foot part to be removed from the middle part. When the carrying apparatus is not being used, the foot support is preferably pushed into the middle part. It remains automatically in this position by means of a spring-loaded fastening.

A retaining strap is advantageously fitted to the foot support as well in order to fix the feet of the person to be rescued.

In the following text, the invention will be explained in more detail in an exemplary embodiment, using the drawings, in which:

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figures 1, 2, 3, 4, 5:
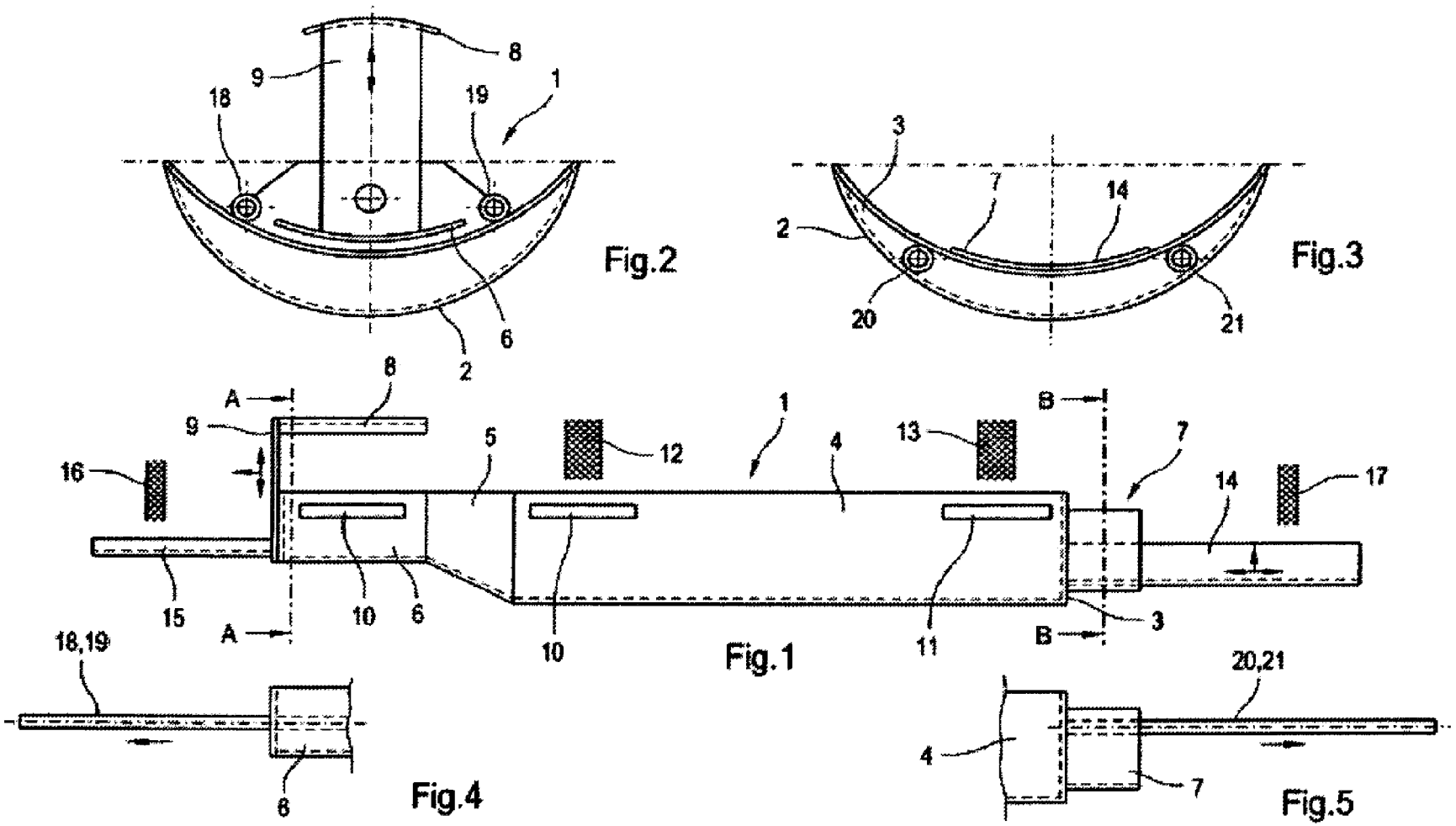
FIG. 1 shows a lateral plan view of a carrying apparatus according to the invention.
FIG. 2 shows a sectional view through the carrying apparatus corresponding to a line A-A from FIG. 1.
FIG. 3 shows a sectional view through the carrying apparatus corresponding to a line B-B from FIG. 1.
FIG. 4 shows a view of a carrying rod 18, 19 that can be pulled out from the head side.
FIG. 5 shows a view of a carrying rod 20, 21 that can be pulled out from the foot side.
Figure 6:
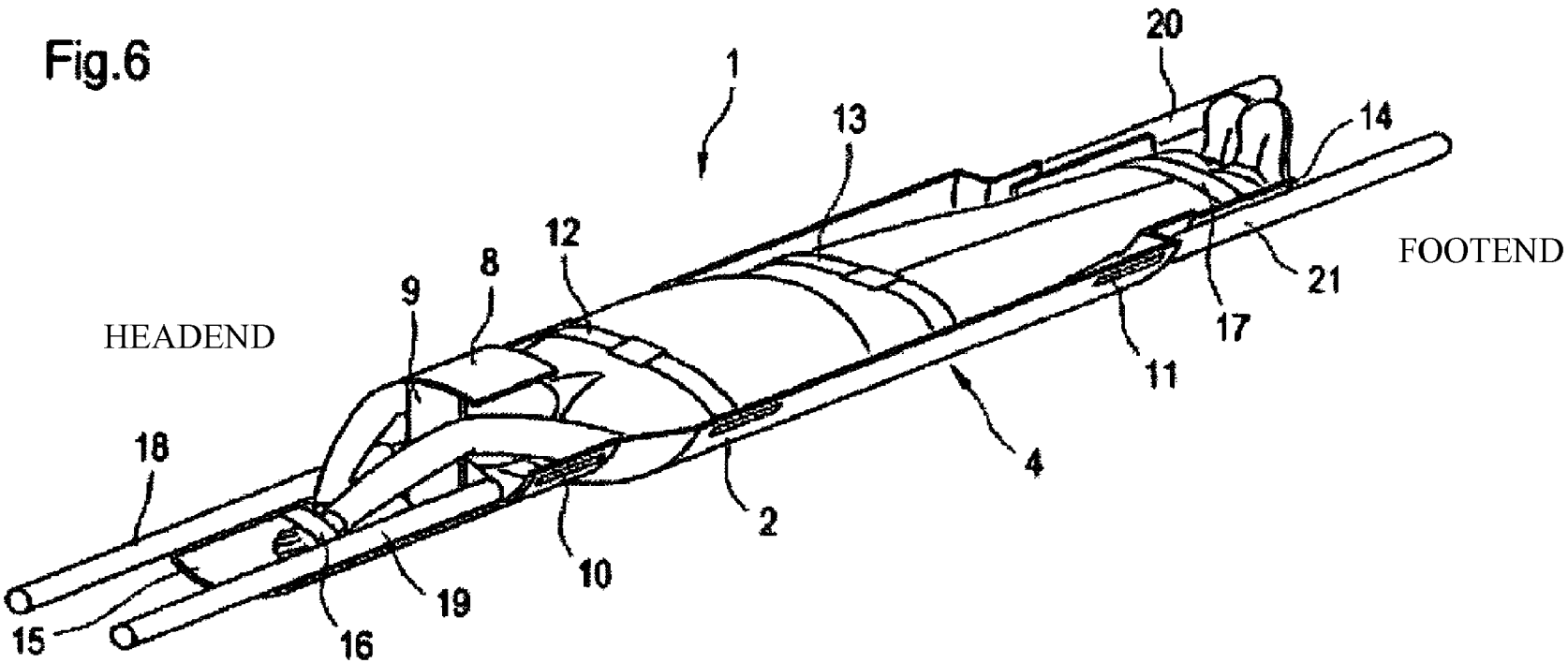
FIG. 6 shows a perspective view of the carrying apparatus with a person fixed on it.

A carrying apparatus 1 (FIGS. 1-6) comprises a shell 2 which is curved to different extents. The shell 2 is preferably produced from a material which has good stability characteristics with a low weight.

Use is made in particular of flat material, such as sheet aluminum, with a thickness of for example 2 to 3 mm or fiberglass, fiber reinforced material, textile, plastic and/or metal fabric or mesh, it being possible for there to be additional reinforcing means, for example in the form of ribs or reinforcing struts.

The carrying apparatus 1 has a middle part 4 which, at its top end, over an intermediate part 5 with a tapering diameter, comprises a head part 6 to hold the head of the person to be rescued, which has a smaller diameter than the middle part 4. At the other end, the middle part 4 comprises a foot part 7 for supporting the lower extremities of the person. An intermediate part 3 for the steep or gradual reduction of the circumference of the middle part 4 in the direction of the foot part 7 can be present between the foot part 7 and the middle part 4.

In the region of the head part 6, a face guard 8 is provided which is connected via a vertical flat part 9 to a rib in the head part 6 and can be adjusted vertically. In the unused state, the face guard 8 can be removed and mounted and fixed on the inside contour of the shell 2, so that it requires no additional space. Openings 10, 11 for holding the carrying apparatus 1 are provided in the head part 6 and in the middle part 4. Likewise, fixings for retaining straps 12, 13 are provided, in particular on the middle part 4.

The foot part 7 of the middle part 4 is preferably adjoined by a foot support 14, in particular one that can be pulled out of the foot part 7, for supporting the legs and feet of the person, which can preferably be pulled out of the foot part 7 and/or the middle part 4 in accordance with the length of the person to be transported.

At the head end of the middle part 4, a hand support 15 (FIG. 6) can be pulled out of the latter and/or out of the head part 6, on which the hands of the person can be placed, stretched upward over the head in extension of the axis of the body, and can be fixed.

Further retaining straps 16, 17 can be fixed to both to the foot support 14 and to the hand support 15. Likewise, holding or carrying rods 18, 19 and 20, 21 can be provided both at the head and at the foot end, the hand support 15 being arranged, for example, between the holding rods 18, 19.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present extends to all functionally equivalent structures, methods and uses, such as are within the scope of the appended claims.

The invention claimed is:

1. A carrying apparatus for rescuing persons comprising:

a middle part which is substantially curved in cross section and is open at the top, that accommodates the trunk of a person to be rescued in a supine position;

a head part associated with the middle part;

a hand support;

a face guard that covers the face of a person to be transported and is nonconfigured as a strap, the face guard and the hand support being a single unit including a substantially vertical member therebetween such that the single unit has an approximate Z-shape, the face guard positioned above the hand support, the single unit being removably attachable to at least one of the middle part and the head part.

2. The carrying apparatus of claim 1, wherein the middle part has a shell that is curved in cross section and has a greater curvature in a middle portion than an outside portion.

3. The carrying apparatus of claim 1, further comprising at least one retaining strap that fastens the trunk of the person to the middle part, and wherein the at least one strap is provided on the middle part.

4. The carrying apparatus of claim 1, which is further equipped with at least one of carrying handles and holding rods.

5. The carrying apparatus of claim 4, wherein the at least one of the carrying handles and holding rods are arranged such that they can be either pulled out of the middle part or that the at least one of the carrying handles and the holding bars are formed as push-in handles.

6. The carrying apparatus of claim 1, which is further equipped with at least one of carrying handles and carrying slots.

7. The carrying apparatus of claim 1, wherein the face guard is arranged such that it can be adjusted vertically with respect to the middle part or a head part.

8. The carrying apparatus of claim 1, wherein the middle part has at least one of a tapered head end and a tapered foot end.

9. The carrying apparatus of claim 1, wherein the hand support can be at least one of pulled and pivoted out of the middle part or the head part.

10. The carrying apparatus of claim 1, further comprising at least one retaining strap that is fitted to the hand support.

11. The carrying apparatus of claim 1, further comprising at least one of a leg support and a foot support that is fitted or can be fitted to the middle part or to a foot end.

12. The carrying apparatus claim 11, wherein at least one retaining strap is fitted to the foot support.

13. The carrying apparatus of claim 11, wherein the foot support can be at least one of pulled and pivoted out of the middle part or the foot end, and wherein the foot support is removable.

14. The carrying apparatus of claim 13, wherein the foot support can be pulled out and not pivoted out of one of the middle part and the foot end.

* * * * *